United States Patent [19]

Meins

[11] 4,415,097

[45] Nov. 15, 1983

[54] DRINKING AID FOR CONTAINERS OF BEVERAGES AND OTHER LIQUIDS

[76] Inventor: Wolfgang Meins, Alsterredder No. 44, D-2000 Hamburg 65, Fed. Rep. of Germany

[21] Appl. No.: 276,782

[22] Filed: Jun. 23, 1981

[30] Foreign Application Priority Data

Jun. 25, 1980 [DE] Fed. Rep. of Germany ..... 3023751

[51] Int. Cl.[3] ..... B65D 25/48

[52] U.S. Cl. ..... 220/90.4; 222/530; 220/90.6

[58] Field of Search ..... 220/90.2, 90.4, 90.6, 220/256; 229/7 R; 222/528, 529, 530, 538, 541

[56] References Cited

U.S. PATENT DOCUMENTS

| | | | |
|---|---|---|---|
| 1,225,017 | 5/1917 | Decker | 222/530 |
| 2,839,229 | 6/1958 | Scheswohl | 222/567 |
| 2,957,614 | 10/1960 | Krajcoviz | 222/530 X |
| 3,197,089 | 7/1965 | Michael | 220/90.6 UX |
| 3,298,577 | 1/1967 | Chlystun | 222/530 X |
| 4,082,827 | 4/1978 | Chlystun | 222/529 X |
| 4,216,880 | 8/1980 | Drelichowski | 222/528 X |

*Primary Examiner*—David A. Scherbel

*Attorney, Agent, or Firm*—Becker & Becker, Inc.

[57] ABSTRACT

A drinking and pouring aid for beverage- and other liquid-containing containers or cans having a pull or press-in tab in the can lid for creating a can opening therein. The drinking aid comprises a plastic synthetic material cover which is adapted to be fastened to the lid of the can, preferably by being snapped thereon; this cover sealingly covers the lid surface of the beverage container, and is provided with a nipple-like mouthpiece in the vicinity of the can opening. This mouthpiece is flexible, and can be folded-in in the vicinity of the outer surface of the cover.

11 Claims, 9 Drawing Figures

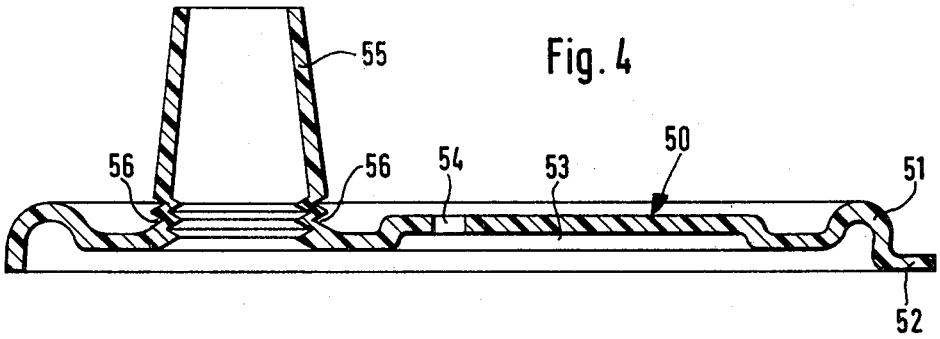
Fig. 4
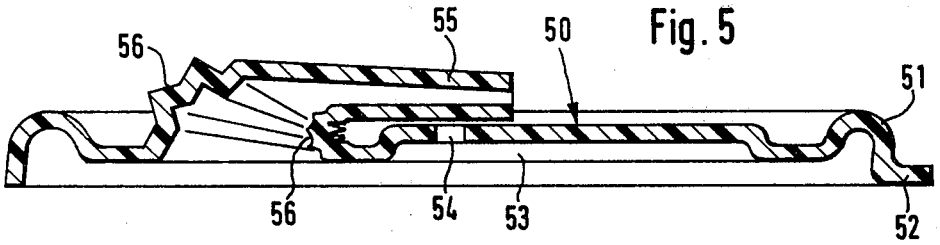
Fig. 5
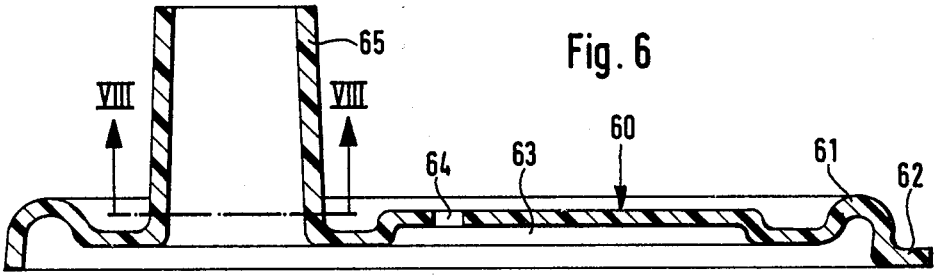
Fig. 6
Fig. 7
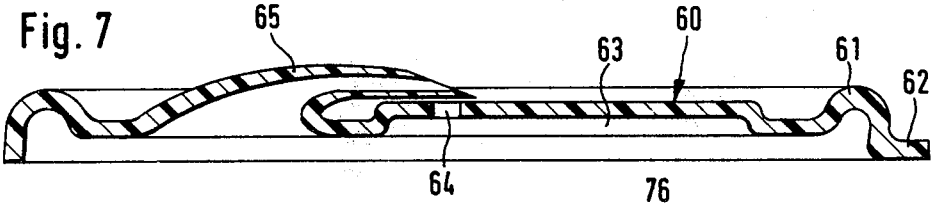
Fig. 8
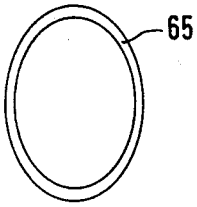
Fig. 9
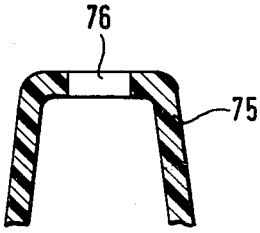

DRINKING AID FOR CONTAINERS OF BEVERAGES AND OTHER LIQUIDS

The present invention provides further improvements relative to features disclosed by copending application Ser. No. 148,727 Meins et al., filed May 12, 1980. This type of drinking aid is provided with a pull or press-in tab in the can lid or cover for creating a can opening therein. Such a drining aid further comprises a cover made of plastic synthetic material which is to be fastened on the lid of the container, preferably by being snapped thereon. This cover sealingly covers the lid or cover surface of the beverage container, and supports a nipple-like mouthpiece in the region of the can opening.

If the container lid-cover is placed on the inside, the nipple-like mouthpiece can actually be accommodated without additional external requirements. However, this rigid integration of the drinking aid is very expensive, since standardized container bottling machines can no longer be used, and the bottling procedure is complicated with special machines. If, according to a further proposal of the aforementioned patent application, a cover is provided which is removable and preferably can be snapped on, the nipple-like mouthpiece, which essentially projects out at right angles, produces a very bulky structure, which, regardless of whether it is placed on the can or is distributed separately, requires a lot of space, which with closely packed beverage cans is generally not available. Covers which are detachable or can be snapped on, and which are provided with nipple-like mouthpieces, can be provided separately from the beverage container proper, but they then require an additional packing space, which must then be provided in distribution as a separate package. However, with a desired quick-service sale of beverage cans, for example at sporting events, the separate handing out of drinking aid and container is very inconvenient. This situation already occurs, for example, with the sale of icecream, for which a spoon still has to be handed out separately.

It is therefore an object of the present invention to eliminate the aforementioned drawbacks and to modify a drinking aid similar to that disclosed in the aforementioned patent disclosure in such a way that the drinking aid can be placed in commerce practically together with the beverage container, and when a container is closed requires little if any additional space.

This object, and other objects and advantages of the present invention, will appear more clearly from the following specification in connection with the accompanying drawings, in which:

FIG. 3 is a view corresponding to that of FIG. 2, but with the nipple-like mouthpiece pushed in;

FIG. 4 is a view similar to that of FIG. 2 showing a second embodiment according to the present invention, in which the nipple-like mouthpiece is adapted to be folded over;

FIG. 5 shows the drinking aid of FIG. 4 with the nipple-like mouthpiece laterally folded over;

FIG. 6 is a view similar to that of FIG. 2, which shows a further embodiment in which the drinking aid is provided with a flexible nipple-like mouthpiece;

FIG. 7 shows the drinking aid of FIG. 6 with the nipple-like mouthpiece being laterally folded over;

FIG. 8 is a cross section taken along the line VIII—VIII of FIG. 6; and

FIG. 9 is a cross section taken through the outer end of a modified nipple-like mouthpiece.

The beverage container drinking aid of the present invention is characterized primarily in that the nipple-like mouthpiece of the container cover is flexible, and is adapted to be folded-in in the vicinity of the outer surface of the cover. This folding-in of the mouthpiece can be effected by providing the wall of the mouthpiece with annularly extending pleats or corrugations, so that the mouthpiece can be pushed-in in the longitudinal direction of the nipple. However, it is also possible to fold over the nipple-like mouthpiece by essentially 90° in order, prior to sale of the container, to releasably hold the mouthpiece in a folded-over or folded-in state by means of an adhesive strip.

Thus, according to further specific embodiments of the present invention, it is possible to design the nipple-like mouthpiece in such a way that it is foldable about its longitudinal axis. In addition, in the region of the base of the mouthpiece, which is connected with the cover, the nipple-like mouthpiece may be provided with folds which simplify the folding over. Rather than having a circular cross section, the nipple-like mouthpiece may also have some other shaped cross section, preferably an elliptical one, in which connection the smallest diameter of the nipple is directed transverse to the folding over axis.

It is also possible to provide a vent in the cover next to the nipple-like mouthpiece. Furthermore, a horizontal recess may be provided on the inner side of the cover for receiving the pull- or press-in tab prior to the container being opened. According to a further proposal of the present invention, the outer end of the nipple-like mouthpiece may be constricted in the form of an annular disc. Prior to being used, the nipple-like mouthpiece may be held in the folded-onto or pressed-in position by means of an adhesive strip or contact adhesive. The underside of the cover may be provided with a contact adhesive layer which is covered with removable silicon paper.

Figure 1:
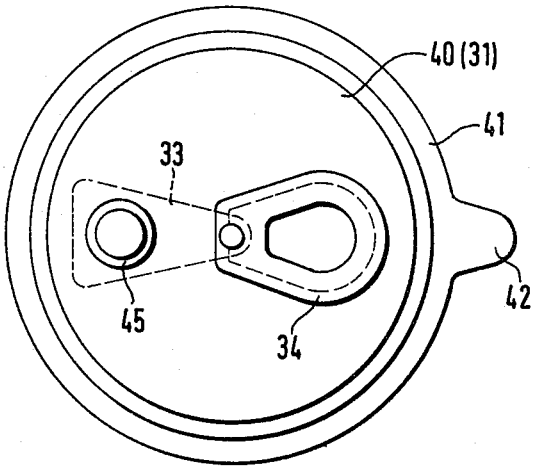
FIG. 1 is a plan view of a commercially available beverage container having one embodiment of the inventive drinking aid placed thereon.
Figure 2:
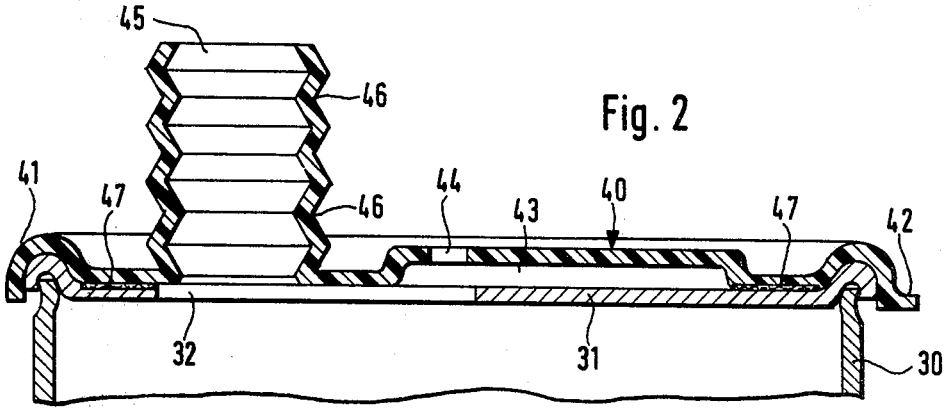
FIG. 2 is a diametral section through the upper part of an open beverage container upon which is placed one embodiment of the inventive drinking aid.

Referring now to the drawings in detail, commercially available containers for beverages generally comprise a deep-drawn, cup-like can body 30, upon the upper opening of which a lid 31 is flanged. The opening in the lid 31 is initially closed off by a portion 33 of the cover plate. This portion 33 of the cover plate can be opened and pulled off in a conventional manner with a pull tab 34, so that thereupon, as shown in FIGS. 2 and 3, the can is opened.

After the commercially available container has been filled with beverage, preferably prior to distribution, it is provided with a cover 40 made of plastic synthetic material. This cover 40 is snapped onto the rolled-in edge of the container cover by means of a slight rolled-in flange 41 on the rim of the cover. A handling extension 42 located on the rim of the cover 40 simplifies placement and removal of the cover. A horizontal recess 34 is located on the underside of the cover 40. The recess 43 is large enough to receive the pull tab 34, which is located on the outer side of the container cover. After the can has been opened, a vent 44 in the cover 40 simplifies drinking from the nipple-like mouthpiece 45, which projects at right angles from the cover surface. As shown in the embodiment of FIGS. 2 and 3, this mouthpiece is provided with annular circumferential corrugations 46, which make it possible to push-in the nipple-like mouthpiece 45 in the manner of an accordion, as shown in FIG. 3.

Figure 3:
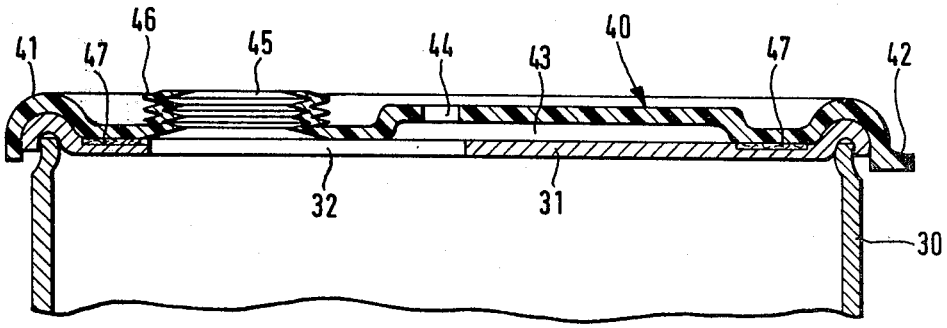

During distribution of the beverage containers, the nipple-like mouthpiece 45 is pushed together or telescoped in the longitudinal direction of the mouthpiece, as shown in FIG. 3. The mouthpiece 45 can be held in the retracted or pushed down position by means of an adhesive strip. In this position, the mouthpiece 45 barely extends beyond the cover surface of the can. During distribution, the beverage container 30, 31 itself is, of course, still completely closed, so that the opening 32 is still sealed, and the pull tabe 34 is located in the recess 43.

In order to drink from the can, the cover 2 is grasped at the handle 42 and is removed. Subsequently, the nipple-like mouthpiece 45 is released by removing the adhesive strip, so that the mouthpiece projects out as shown in FIG. 2. After the beverage container has been subsequently opened with the aid of the pull tabe 34, the cover 40 can again be placed on the can, so that one can then drink from the nipple 45. In order to further improve the seal between the cover 40 and the outside of the lid 31, an adhesive layer 47 which is protected with silicon paper can be placed on the underside of the cover 40. In this case, the silicon paper can be removed prior to placement of the cover 40, in order to subsequently ensure an absolute liquid seal of the cover 40 about the nipple-like mouthpiece 45.

In the embodiment of FIGS. 4 and 5, the cover 50 likewise comprises a rolled-in flange 51, a handling extension 52, a recess 53 for the pull tab 34, a vent 54, and a nipple-like mouthpiece 55. In this embodiment, the mouthpiece 55 is somewhat conical. The base region of the mouthpiece 55 is provided with additional folds 56 which make it possible to fold the nipple-like mouthpiece 55 over, as shown in FIG. 5. In this case also the nipple-like mouthpiece 55 can be secured with an adhesive strip in the position of non-use. An additional seal, such as the adhesive layer 47 shown in FIG. 2, is also possible.

The embodiment of FIGS. 6 and 7 is similar to the embodiment of FIGS. 4 and 5, yet without the additional folds at the base of the nipple. However, the nipple 65 is nonetheless flexible, so that it can be folded over as with the embodiments of FIGS. 4 and 5. In the embodiment of FIGS. 6 and 7, the structural elements 61 to 64 of the cover 60 correspond to the structural elements 51 to 54 of the embodiments of FIGS. 4 and 5.

In order to simplify the lateral folding over of the nipple-like mouthpiece 55 and 65 in a predetermined direction, the cross section of the mouthpiece, rather than being circular, can, for example, be oval, as shown in FIG. 8. A flattened mouthpiece simplifies bending the mouthpiece about the axis having the greatest dimension.

The embodiments of FIGS. 4 to 8 can be handled in the same way as was described in the connection with the embodiments of FIGS. 2 and 3.

If the nipple-like mouthpiece 75 is constructed as shown in FIG. 9, so that the drinking opening 76 itself is constricted in the manner of annular discs, the advantage is obtained that if a person is drinking while walking or while in a moving vehicle, it is not so easy to spill the drink out of the opening of the mouthpiece. In addition, the danger of injury to consumer lips on a mouthpiece having a sharp edge at the end thereof is reduced.

The outside of the container drinking aid is of course a prominent place for advertising, since the person drinking out of the can is constantly looking at this surface.

In addition to the aforementioned possibility of holding the nipple-like mouthpiece in the pushed-in or folded-onto position prior to use by means of an adhesive strip, it is further possible to cover the beverage containers individually or in groups with a shrunk-on foil which then assures that the mouthpieces are held in the pushed-in or folded-onto position.

The container drinking aid is preferably made by injection molding or with evacuated dies using predominantly soft and resilient synthetic material which is compatible with foodstuffs.

If, with a beverage container which is ready for drinking, the drinking aid is twisted relative to the can, or if the drinking aid is removed and put on again after being twisted, the can is again closed off, at least if the nipple-like mouthpiece is no longer aligned with the opening of the can cover.

The present invention is, of course, in no way restricted to the specific disclosure of the specification and drawings, but also encompasses any modifications within the scope of the appended claims.

What I claim is:

1. A drinking aid for containers which are adapted to contain beverages and other liquids and are respectively provided with a tab opener associated with a container lid for creating a container opening therein, said aid comprising:

a cover of plastic synthetic material including an outer surface and a surface facing said container lid, said cover being releasably fastened to said container lid for sealingly covering the surface of said lid; and a nipple-like mouthpiece, one end of which is connected to said cover in the region of said container opening, said cover including a vent in the vicinity of said mouthpiece, said mouthpiece having a longitudinal axis as well as being flexible and being foldable into the region of the outer surface of said cover, said mouthpiece being bendable about the longitudinal axis thereof, said mouthpiece having a non-circular cross-section, the smallest diameter of which is directed in the desired bending direction, that surface of said cover facing said container lid being provided with a recess for receiving said tab opener prior to use thereof for creating said container opening.

2. A drinking aid according to claim 1, in which said mouthpiece is provided with annular corrugations in such a way that said mouthpiece can be pushed together in the longitudinal direction.

3. A drinking aid according to claim 1, in which that region of said mouthpiece which is connected to said cover is provided with folds to facilitate said bending.

4. A drinking aid according to claim 1, in which that end of said mouthpiece remote from said end thereof connected to said cover is provided with a constriction in the form of an annular disc.

5. A drinking aid according to claim 1, which includes adhesive means for holding said mouthpiece in a folded-in state prior to use thereof.

6. A drinking aid according to claim 1, in which that surface of said cover facing said container lid is provided with an adhesive layer cover with removable silicon paper.

7. A drinking aid for containers which are adapted to contain beverages and other liquids and are respectively provided with a tab opener associated with the container lid for creating a container opening therein, said aid comprising:

a cover, of plastic synthetic material, releasably fastened to said container lid for sealingly covering the surface of said lid; and a nipple-like mouthpiece, one end of which is connected to said cover in the region of said container opening, said mouthpiece being flexible and being foldable into the region of the outer surface of said cover, said cover including a vent in the vicinity of said mouthpiece, that surface of said cover facing said container lid being provided with a recess for receiving said tab opener prior to use thereof for creating said container opening.

8. A drinking aid for containers which are adapted to contain beverages and other liquids and are respectively provided with a tab opener associated with the container lid for creating a container opening therein, said aid comprising:

a cover, of plastic synthetic material, releasably fastened to said container lid for sealingly covering the surface of said lid;

and a nipple-like mouthpiece, one end of which is connected to said cover in the region of said container opening, said mouthpiece being flexible and being foldable into the region of the outer surface of said cover, that end of said mouthpiece remote from said end thereof connected to said cover being provided with a constriction in the form of an annular disc.

9. A drinking aid according to claim 8, in which said mouthpiece is bendable about its longitudinal axis.

10. A drinking aid according to claim 9, in which said mouthpiece has a noncircular cross section, the smallest diameter of which is directed in the desired bending direction.

11. A drinking aid according to claim 10, in which said cover includes a vent in the vicinity of said mouthpiece.

* * * * *